US006344826B1

(12) United States Patent
Matsuura et al.

(10) Patent No.: US 6,344,826 B1
(45) Date of Patent: Feb. 5, 2002

(54) ANTENNA FOR RADIO COMMUNICATION TERMINAL

(75) Inventors: Iwao Matsuura; Hideki Yagita, both of Kanagawa; Hideo Nagata, Shizuoka, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/671,394

(22) Filed: Sep. 27, 2000

(30) Foreign Application Priority Data

Sep. 28, 1999 (JP) ..... 11-274329

(51) Int. Cl.[7] ..... H01Q 1/24

(52) U.S. Cl. ..... 343/702; 343/860; 343/876; 343/901

(58) Field of Search ..... 343/702, 900, 343/901, 860, 876, 846, 895

(56) References Cited

U.S. PATENT DOCUMENTS 5,030,966 A * 7/1991 Chin et al. ..... 343/702
5,374,937 A * 12/1994 Tsunekawa et al. ..... 343/702
5,774,794 A * 6/1998 Kido ..... 343/702
5,794,158 A * 8/1998 Itoh ..... 343/702
5,801,662 A * 9/1998 Itoh ..... 343/702
5,923,297 A * 7/1999 Kim et al. ..... 343/702

* cited by examiner

*Primary Examiner*—Don Wong
*Assistant Examiner*—Hoang Nguyen
(74) *Attorney, Agent, or Firm*—Pearne & Gordon LLP

(57) ABSTRACT

When the antenna is extended, the length of the ½λ whip antenna 102 operates as an antenna thus causing only a negligible quantity of high-frequency currents to flow into the ground for the circuit board 108. When the antenna is housed, the entire length of a ¼λ helical antenna 101 and a ¼λ radial 109 operates as an antenna thus causing only a negligible quantity of high-frequency currents to flow into the ground for the circuit board 108. When the antenna is extended, the second contact 104 makes adjustments so that high-frequency electric signals from the ½λ whip antenna 102 may be transmitted to the circuit board 108 and matching may be provided at the second matching section 106 when the antenna is extended. When the antenna is housed, the first contact 103 makes adjustments so that high-frequency electric signals from the ¼λ helical antenna 101 may be transmitted to the circuit board 108 and matching may be provided at the first matching section 105 when the antenna is housed.

12 Claims, 5 Drawing Sheets

ANTENNA FOR RADIO COMMUNICATION TERMINAL

BACKGROUND OF THE INVENTION

The present invention relates to an antenna for radio communication terminal apparatus connected to information processing apparatus such as a personal computer and a personal digital assistant (PDA), adapted to reduce a high-frequency noise component entering the high-frequency circuit of the radio communication apparatus, the noise component originating from the control circuit of information processing apparatus such as a personal computer or a PDA.

Conventionally, it was a customary practice to use a ¼λ to ⅜λ whip antenna as an antenna for radio communication terminal apparatus where a high-frequency circuit, a communication control circuit and an antenna were integrated.

FIG. 5 shows a configuration of radio communication terminal apparatus that uses a conventional ¼λ whip antenna. In the radio communication terminal apparatus, a circuit board 141 is composed of a high-frequency circuit 139 and a communication control circuit 140, and the antenna portion is integrated by connecting the high-frequency circuit 139 and the ¼λ whip antenna 135.

A ¼λ to ⅜λ whip antenna requires a favorable ground for operation as an antenna. For radio communication terminal apparatus that requires a compact design generally uses the ground for the circuit board 141 also as a ground operating as an antenna radial.

However, the conventional ¼λ to ⅜λ whip antenna requires a broad and stable ground surface in order to obtain stable characteristics.

Conventionally, the ground surface of a circuit board also plays the role of an antenna ground for radio communication terminal apparatus that requires a compact design. Further downsizing is under way in recent radio communication terminal apparatus. This makes it difficult to provide a sufficiently stable and wide antenna ground.

For a one-piece design comprising a high-frequency circuit and a communication control circuit in radio communication terminal apparatus shown in FIG. 5, there is a problem that, in case the role of an antenna ground is played by the ground for the communication control circuit, a high-frequency noise component enters the high-frequency circuit via the ground for the circuit board, the noise component originating from the communication control circuit of the radio communication terminal apparatus.

Also in case radio communication terminal apparatus is connected to information processing apparatus such as a personal computer and a PDA, there is a problem that a high-frequency noise component enters the high-frequency circuit via the ground for the radio communication apparatus, the noise component originating from the control circuit of the information processing apparatus.

Thus, in case a high-frequency component noise originating from the control circuit is a noise signal whose frequency is the same as the receiving frequency in radio communication terminal apparatus, there arises a problem of a cochannel suppression interference.

SUMMARY OF THE INVENTION

The invention solves the problem and aims at providing an excellent antenna for radio communication terminal apparatus that can reduce a high-frequency noise component entering the high-frequency circuit via ground for the circuit board, the noise component originating from the control circuit and having the same frequency as the receiving frequency in the radio communication terminal apparatus, without impairing antenna characteristics.

The first aspect of the invention is an antenna for radio communications apparatus, in that separate matching circuits are provided for an extended antenna and a housed antenna and a ground for a circuit board is separated from a ground operating as an antenna radial in order for the length of the antenna operates at ½λ both when the antenna is housed and when it is extended thus preventing high-frequency currents of the antenna from flowing into information processing apparatus via the ground for the circuit board, and that the electrical operation length of the antenna is arranged outside the information processing apparatus in order to place a noise source at a distance from the current loop of the antenna.

Via this configuration, it is possible to reduce a high-frequency noise component entering the high-frequency circuit via the ground for the circuit board, the noise component originating from communication control circuit, without impairing antenna characteristics.

The second aspect of the invention is an antenna for radio communications apparatus according to the first aspect of the invention, in that plural stage rods are used as antenna elements.

Via this configuration, the antenna operates the same way as the first aspect of the invention when the antenna is extended and the antenna set can be made compact by telescoping the rods.

The third aspect of the invention is an antenna for radio communications apparatus according to the first aspect of the invention, in that the antenna is configured to be ¼λ whip+¼λ radial both when the antenna is extended and housed.

Via this configuration, by making the antenna length ½λ., it is possible to reduce a high-frequency noise component entering the high-frequency circuit, the noise component originating from communication control circuit, without letting excessive high-frequency currents flow on a circuit board.

The fourth aspect of the invention is an antenna for radio communication terminal apparatus according to any of the first through third aspects of the invention, in that the electrical length corresponding to ¼λ whip when the antenna is housed is a helical type.

Via this configuration, by making the electrical length corresponding to ¼λ whip a helical type, an antenna set can be downsized when it is housed.

The fifth aspect of the invention is an antenna for radio communication terminal apparatus according to any of the first through third aspects of the invention, in that the electrical length corresponding to ¼λ radial is a helical type.

Via this configuration, by making the electrical length corresponding to ¼λ radial a helical type, an antenna set can be downsized when it is housed.

The sixth aspect of the invention is an antenna for radio communication terminal apparatus according to any of the first through third aspects of the invention, in that the electrical length corresponding to ¼λ whip when the antenna is housed and to ¼λ radial is a helical type.

Via this configuration, by making the electrical length corresponding to ¼λ whip when the antenna is housed and to ¼λ radial a helical type, an antenna set and an antenna ground can be downsized.

The seventh aspect of the invention is an antenna for radio communication terminal apparatus according to first aspect of the invention, in that the antenna operates at ¼λ helical+ ¼λ radial when it is housed and at ½λ whip when it is extended.

Via this configuration, by feeding power at the lowest end of ½λ whip, the current loop of the antenna can be placed at a distance from the noise source, thus reducing a high-frequency noise component entering the high-frequency circuit, the noise component originating from the communication control circuit.

The eighth aspect of the invention is an antenna for radio communication terminal apparatus according to first aspect of the invention, in that the antenna operates at ¼λ helical+ ¼λ radial when it is housed and at ½λ helical when it is extended.

Via this configuration, by feeding power at the lowest end of ½λ helical, the current loop of the antenna can be placed at a distance from the noise source, thus reducing a high-frequency noise component entering the high-frequency circuit, the noise component originating from the communication control circuit.

Also, by making the length of the antenna when it is extended ½λ helical, the antenna set when it is extended can be shortened.

The ninth aspect of the invention is an antenna for radio communication terminal apparatus according to first aspect of the invention, in that the antenna operates at ½λ whip both when it is housed and extended.

Via this configuration, a matching circuit can be used in common both when the antenna is housed and extended.

The tenth aspect of the invention is an antenna for radio communication terminal apparatus according to first aspect of the invention, in that the antenna operates at ½λ helical both when it is housed and extended Via this configuration, a matching circuit can be used in common and the antenna set can be downsized both when the antenna is housed and extended.

The eleventh aspect of the invention is an antenna for radio communication terminal apparatus according to first aspect of the invention, in that a mechanical contact is used for switching between the two states, when an antenna is extended and when it is housed.

Via this configuration, antenna elements can kept in contact by a spring contact. This facilitates switching between the two states, when an antenna is extended and when it is housed, without increasing current consumption.

The twelfth aspect of the invention is an antenna for radio communication terminal apparatus according to first aspect of the invention, in that a micro-switch and a high-frequency switch IC are used for switching between the two states, when an antenna is extended and when it is housed.

Via this configuration, separate matching circuits can be switched between the two states, when an antenna is housed and when it is extended.

DETAILED DESCRIPTION OF THE PREFERRED EMBODIMENTS

Embodiments of the invention will be explained below with reference to FIG. 1 through FIG. 4.

First Embodiment

Figure 1:
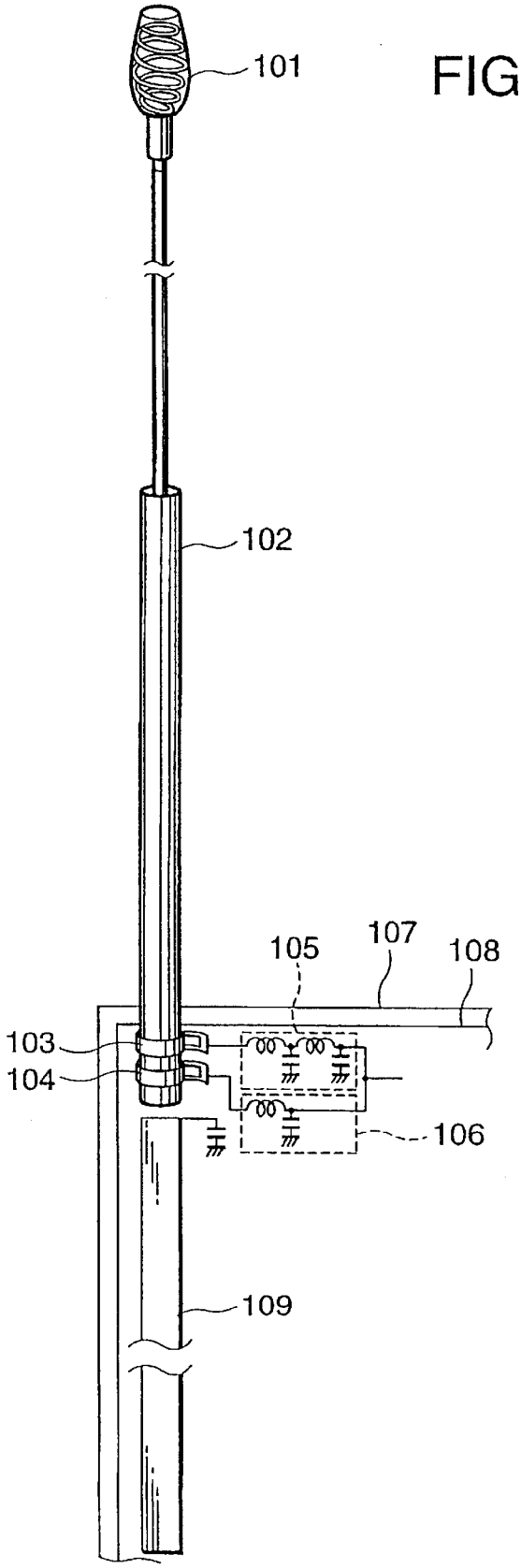
FIG. 1 shows a configuration of an antenna for radio communication terminal apparatus according to the first embodiment of the invention.

FIG. 1 shows a configuration of an antenna for radio communication terminal apparatus according to the first embodiment of the invention. In FIG. 1, the configuration related to the antenna for the radio communication terminal apparatus comprises a ¼λ helical antenna 101, a ½λ whip antenna 102, a first contact 103, a second contact 104, a first matching section 105, a second matching section 106, an enclosure 107, a circuit board 108, and a ¼λ radial 109.

Operation of the antenna for radio communication terminal apparatus thus configured will be explained. When the antenna is extended, the length of the ½λ whip antenna 102 operates as an antenna thus causing only a negligible quantity of high-frequency currents to flow into the ground for the circuit board 108. The ½λ whip antenna 102 may be configured by two or more stages of rods.

When the antenna is housed, the length of the ¼λ helical antenna 101 and ¼λ radial 109 operates as an antenna thus causing only a negligible quantity of high-frequency currents to flow into the ground for the circuit board 108.

When the antenna is extended, the second contact 104 makes adjustments so that high-frequency electric signals from the ½λ whip antenna 102 may be transmitted to the circuit board 108 and matching may be provided at the second matching section 106 when the antenna is extended.

When the antenna is housed, the first contact 103 makes adjustments so that high-frequency electric signals from the ¼λ helical antenna 101 may be transmitted to the circuit board 108 and matching may be provided at the first matching section 105 when the antenna is housed.

The length of the antenna is ½λ both when the antenna is extended and housed. This causes only a negligible quantity of high-frequency currents to flow into the ground for the circuit board 108. This prevents a controller noise from flowing into information processing apparatus via the ground for the circuit board 108.

Second Embodiment

Figure 2:
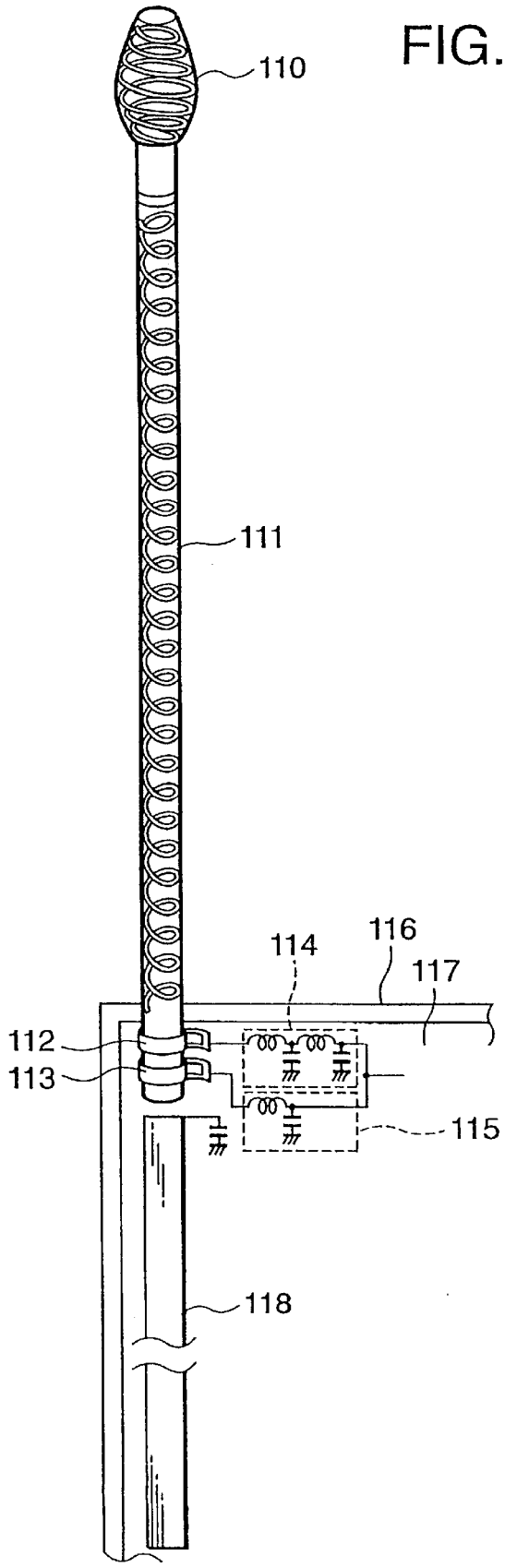
FIG. 2 shows a configuration of an antenna for radio communication terminal apparatus according to the second embodiment of the invention.

FIG. 2 shows a configuration of an antenna for radio communication terminal apparatus according to the second embodiment of the invention. In FIG. 2, the configuration related to the antenna for the radio communication terminal apparatus comprises a ¼λ helical antenna 110, a ½λ helical antenna 111, a first contact 112, a second contact 113, a first matching section 114, a second matching section 115, an enclosure 116, a circuit board 117, and a ¼λ radial 118.

Operation of the antenna for radio communication terminal apparatus thus configured will be explained. When the antenna is extended, the length of the ½λ helical antenna 111 operates as an antenna thus causing only a negligible quantity of high-frequency currents to flow into the ground for the circuit board 117.

When the antenna is housed, the length of the ¼λ helical antenna 110 and ¼λ radial 118 operates as an antenna thus causing only a negligible quantity of high-frequency currents to flow into the ground for the circuit board 117.

When the antenna is extended, the second contact 113 makes adjustments so that high-frequency electric signals from the ½λ helical antenna 111 may be transmitted to the circuit board 117 and matching may be provided at the second matching section 115 when the antenna is extended.

When the antenna is housed, the first contact 112 makes adjustments so that high-frequency electric signals from the ¼λ helical antenna 110 may be transmitted to the circuit board 117 and matching may be provided at the first matching section 114 when the antenna is housed.

Same as the first embodiment, the length of the antenna is ½λ both when the antenna is extended and housed. This prevents a controller noise from flowing into information processing apparatus via the ground for the circuit board 108. Further, use of the ½λ helical antenna 111 downsizes the antenna when it is extended.

Third Embodiment

Figure 3:
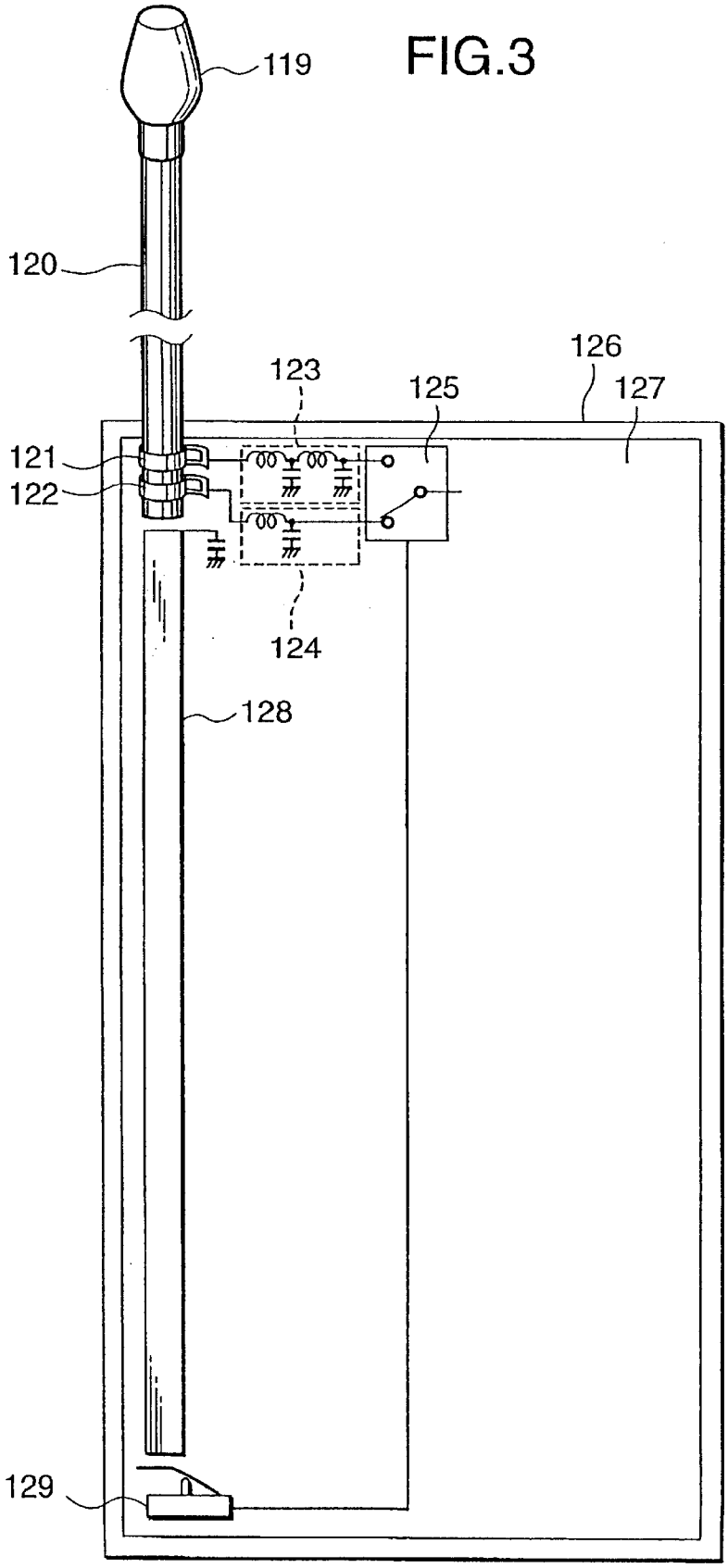
FIG. 3 shows a configuration of matching switchover between the two states, when the antenna is extended and when it is housed, according to the third embodiment of the invention.

FIG. 3 shows a configuration of matching switchover between the two states, when the antenna is extended and when it is housed, according to the third embodiment of the invention. In FIG. 3, the configuration related to matching switchover between the two states, when the antenna is housed and when it is extended, comprises a ¼λ helical antenna 119, a ½λ whip antenna 120, a first contact 121, a second contact 122, a first matching section 123, a second matching section 124, a high-frequency switch IC 125, an enclosure 126, a circuit board 127, a ¼λ radial 128, and a micro-switch- 129.

When the antenna is extended, the feeding point of the ½λ whip antenna 120 is connected to the contact of the circuit board 127 at the second contact 122 and matched to 50 ohms at the second matching section 124. The micro-switch 129 is in the OFF position and the high-frequency switch IC 125 is connected to the second matching section 124.

When the antenna is housed, the feeding point of the ¼λ helical antenna 119 is connected to the contact of the circuit board 127 at the first contact 121 and matched to 50 ohms at the first matching section 123.

When the ½λ whip antenna 120 is housed, it is open electrically and its lower end turns on the micro-switch 129.

By turning on the micro-switch, the high-frequency switch IC 125 is connected to the first matching section 123. Antenna operation in this case is performed by the ¼λ helical antenna 119 and the ¼λ radial 128.

In case matching is difficult for a combination of a house antenna and an extended antenna, separate matching circuits switched between the two states of the antenna can provide matching with ease.

Fourth Embodiment

Figure 4:
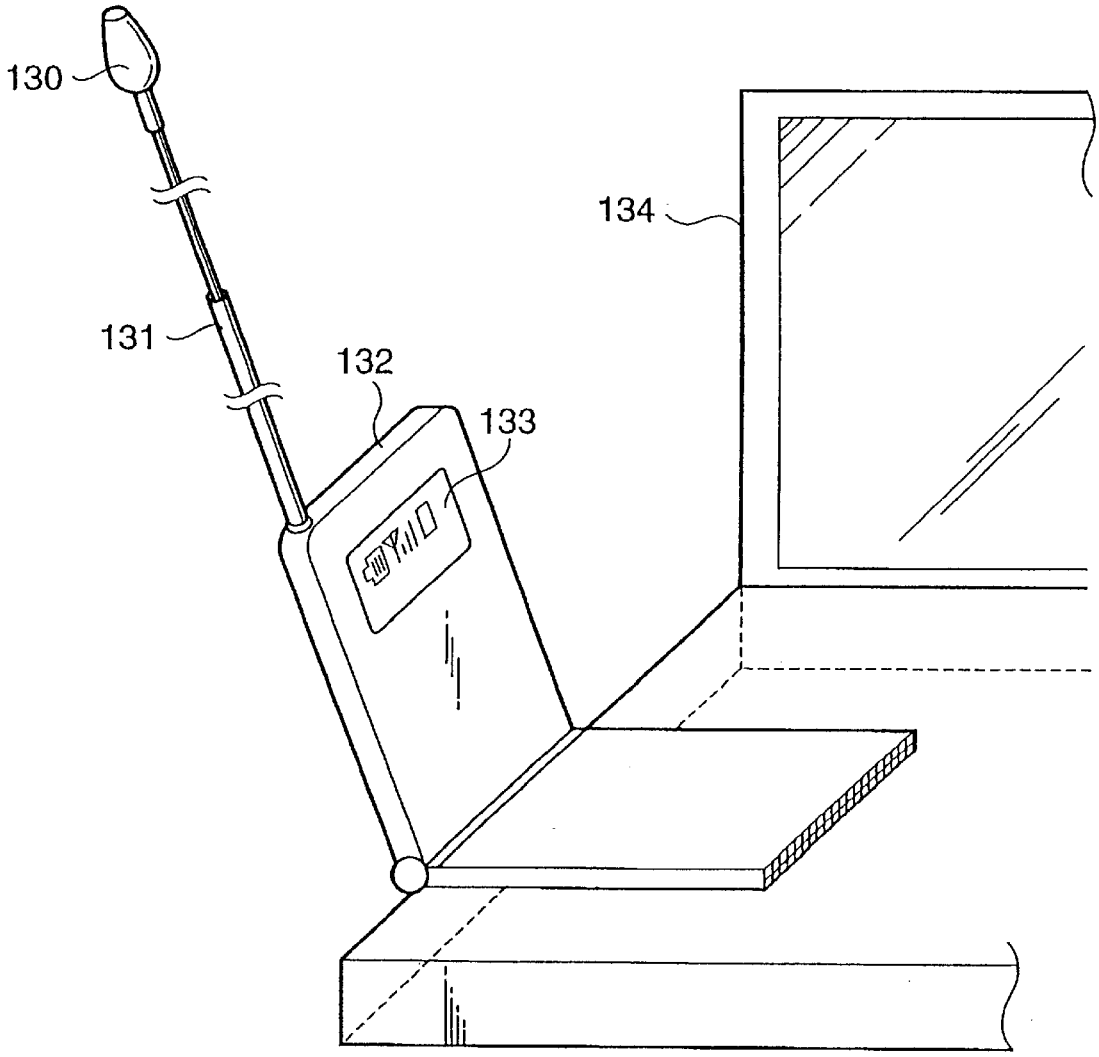
FIG. 4 shows a configuration of radio communication terminal apparatus equipped with an antenna for radio communication terminal apparatus according to the fourth embodiment of the invention.
Figure 5:
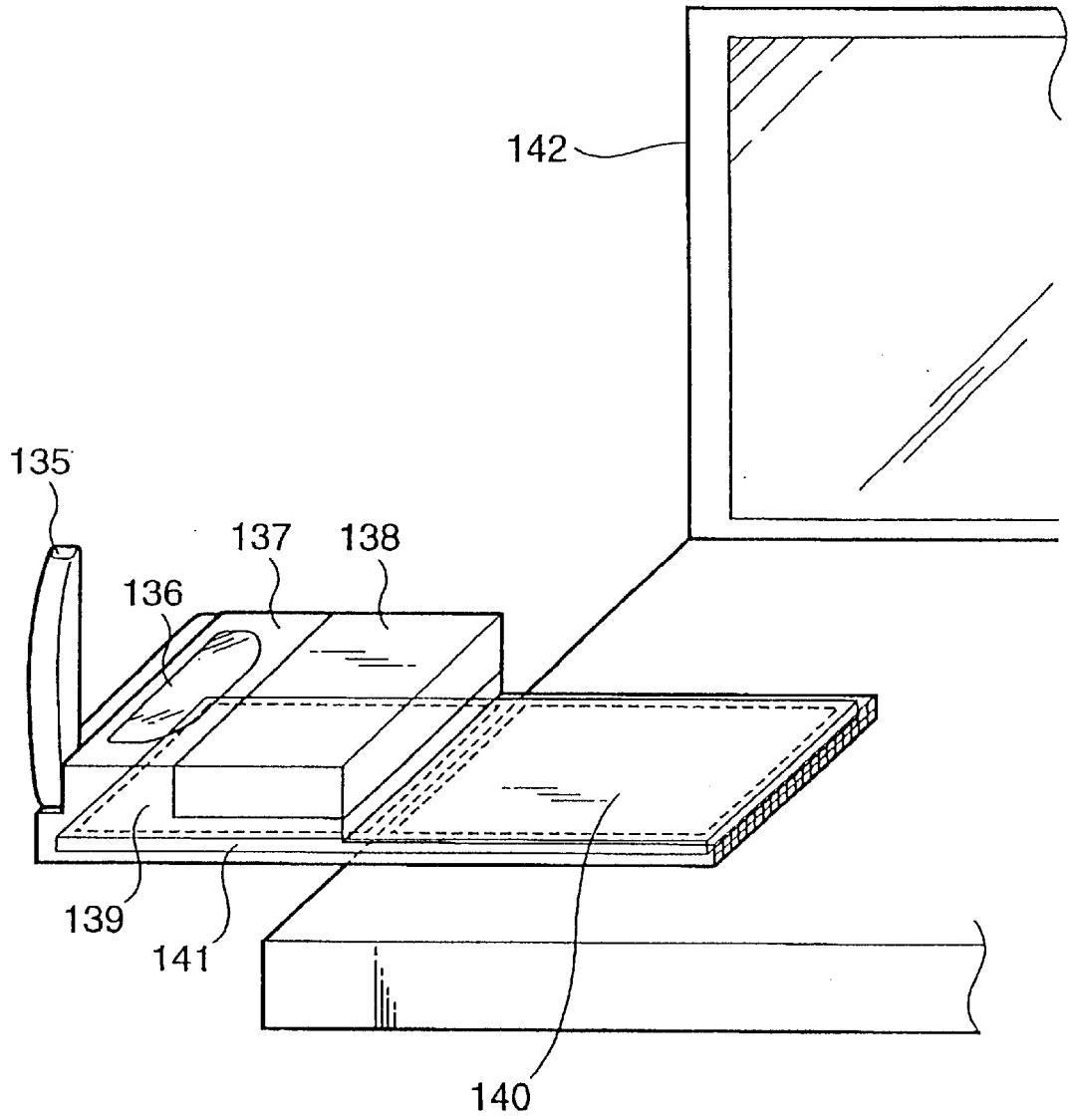
FIG. 5 shows a configuration of radio communication terminal apparatus that uses a conventional ¼λ whip antenna.

FIG. 4 shows a configuration of radio communication terminal apparatus equipped with an antenna for radio communication terminal apparatus according to the fourth embodiment of the invention. In FIG. 4, the configuration related to the antenna for the radio communication terminal apparatus comprises a ¼λ helical antenna 130, a ½λ whip antenna 131, an enclosure 132, an LCD 133, and a laptop PC 134.

The antenna for radio communication terminal apparatus thus configured is characterized in that the entire ½λ whip antenna 131 operates as an antenna when the antenna is extended and only a negligible quantity of high-frequency currents flows into the ground for the circuit board.

Accordingly, it is possible to reduce a high-frequency noise component entering the high-frequency circuit of the radio communication apparatus via the ground for the circuit board, the noise component originating from the laptop PC 134.

As mentioned earlier, the invention provides an antenna for radio communication apparatus, characterized in that separate matching circuits are provided for an extended antenna and a housed antenna and a ground for a circuit board is separated from a ground operating as an antenna radial in order for the length of the antenna operates at ½λ thus preventing high-frequency currents of the antenna from flowing into information processing apparatus via the ground for the circuit board, and that the electrical operation length of the antenna is arranged outside the information processing apparatus in order to place a noise source at a distance from the current loop of the antenna.

Via this configuration, it is possible to obtain an excellent antenna for radio communication terminal apparatus that can reduce a high-frequency noise component entering the high-frequency circuit via the ground for the circuit board, the noise component originating from communication control circuit, without impairing antenna characteristics.

What is claimed is:

1. An antenna for radio communications apparatus comprising:

a first matching circuit for the antenna in a housed position;

a second matching circuit for the antenna in an extended position; and a ground operating an antenna radial section, which is separated from a ground for a circuit board;

wherein said antenna is operated as electric length of the antenna at ½λ both when said antenna is housed and when it is extended thus preventing high-frequency currents of said antenna from flowing into information processing apparatus via the ground for the circuit board, and that the electrical operation length of the antenna is arranged outside said information processing apparatus in order to place a noise source at a distance from the current loop of the antenna.

2. An antenna for radio communications apparatus according to claim 1, characterized in that two or more rods are used as elements of the antenna in said extended position.

3. An antenna for radio communications apparatus according to claim 1, characterized in that said antenna is configured to be ¼λ whip+¼λ radial both when the antenna is extended and housed.

4. An antenna for radio communications apparatus according to any of claims 1 through 3, characterized in that the electrical length corresponding to ¼λ whip when the antenna is housed is a helical type.

5. An antenna for radio communications apparatus according to any of claims 1 through 3, characterized in that the electrical length corresponding to ¼λ radial is a helical type.

6. An antenna for radio communications apparatus according to any of claims 1 through 3, characterized in that the electrical length corresponding to ¼λ whip when the antenna is housed and to ¼λ radial is a helical type.

7. An antenna for radio communications apparatus according to claim 1, characterized in that the antenna operates at ¼λ helical+¼λ radial when it is housed and at ½λ whip when it is extended.

8. An antenna for radio communications apparatus according to claim 1, characterized in that the antenna operates at ¼λ helical+¼λ radial when it is housed and at ½λ helical when it is extended.

9. An antenna for radio communications apparatus according to claim 1, characterized in that the antenna operates at ½λ whip both when it is housed and extended.

10. An antenna for radio communications apparatus according to claim 1, characterized in that the antenna operates at ½λ helical both when it is housed and extended.

11. An antenna for radio communications apparatus according to claim 1, characterized in that a mechanical contact is used for switching between the two states, when an antenna is extended and when it is housed.

12. An antenna for radio communications apparatus comprising:

a first matching circuit for the antenna in a housed position;

a second matching circuit for the antenna in an extended position; and a ground operating an antenna radial section, which is separated from a ground for a circuit board;

wherein said antenna is operated as electric length of the antenna at ½λ both when said antenna is housed and when it is extended thus preventing high-frequency currents of said antenna from flowing into information processing apparatus via the ground for the circuit board, and that the electrical operation length of the antenna is arranged outside said information processing apparatus in order to place a noise source at a distance from the current loop of the antenna;

characterized in that a micro-switch and a high-frequency switch IC are used for switching between the two states, when an antenna is extended and when it is housed.

* * * * *